US005211555A

United States Patent [19]

Gardner et al.

[11] Patent Number: 5,211,555

[45] Date of Patent: May 18, 1993

[54] MELTING APPARATUS AND METHOD

[75] Inventors: Keith M. Gardner, Sylvania, Ohio; Frank J. Vereecke, Palmyra, Mich.; Wayne R. Klemmensen, Toledo, Ohio

[73] Assignee: Gas Research Institute, Chicago, Ill.

[21] Appl. No.: 806,617

[22] Filed: Dec. 12, 1991

[51] Int. Cl.[5] ..... F27B 3/18

[52] U.S. Cl. ..... 432/161; 432/159; 432/178; 126/343.5 A; 266/214

[58] Field of Search ..... 432/178, 179, 161; 266/214; 126/343.5 A

[56] References Cited

U.S. PATENT DOCUMENTS

| | | | |
|---|---|---|---|
| 1,869,591 | 8/1932 | Wagstaff | 432/161 |
| 3,510,289 | 5/1970 | Boivent | 432/161 |
| 3,526,492 | 9/1970 | Motsch | 432/161 |
| 3,620,514 | 11/1971 | Geiger, Jr. | 432/161 |
| 3,633,886 | 1/1972 | Froberg | 432/161 |
| 4,255,136 | 3/1981 | Suzuki et al. | 432/178 |
| 4,781,581 | 11/1988 | Bleickert et al. | 432/159 |
| 4,848,420 | 7/1989 | Claassen | 126/343.5 A |

*Primary Examiner*—Henry C. Yuen
*Attorney, Agent, or Firm*—Harold F. Mensing

[57] ABSTRACT

A gas fired melting apparatus for particulate material. The melting apparatus has four successively connected vertically disposed sidewall members, a floor member and a roof member. These members define a cubic melting chamber for containing a freestanding generally conical pile of particulate material to be melted. The sizes, shapes and positions of the chamber radiating surfaces as well as their relative distances from the pile surfaces promote heat transfer to the pile. A high temperature gas fired burner is mounted in each sidewall adjacent to the corner formed by the tail end of one sidewall and the head end of a successive sidewall member. The axis of each burner is parallel with its successive wall member so the combined effect of the burners is to produce a toroidal flow of combustion products in the melting chamber around its central vertical axis. The melting apparatus includes a gas fired forehearth assembly comprising two branching forehearths which communicate with the melting chamber through a single inlet opening located centrally in one sidewall member of the chamber, and a recuperator assembly communicating with the melting chamber through an outlet opening in an opposite sidewall member. An opening is provided in the center of the roof member to admit feedstock to the melting chamber.

23 Claims, 2 Drawing Sheets

MELTING APPARATUS AND METHOD

BACKGROUND OF THE INVENTION

This invention relates to a melting apparatus for particulate material. More specifically, it relates to a gas fired apparatus for melting a freestanding pile of particulate feedstock in a cubic melting chamber.

Prior art apparatuses for melting particulate material generally utilized the off-gases of the melting process to preheat the feedstock by forcing the off-gases through the feedstock outside the melting chamber. To do this effectively, required the feedstock mass to be relatively homogeneous so as to provide uniform permeability and that this uniform permeability be maintained from the beginning of the preheating step to its end. Otherwise, the flow of off-gases would become channelized and overheat some portions of the feedstock while leaving other portions unheated. Localized hot and cold spots caused clumping which impeded the uniform movement of feedstock into the melting chamber. In severe cases, an entire layer of feedstock might coalesce and form a bridge across the feedstock entry to the melting chamber and thus stop the flow of material completely. Furthermore, where the prior art apparatus called for all the off-gases from the melter to be cycled through a column of feedstock in a vertical shaft preheater, any impairment or stoppage of the flow of off-gases would produce a corresponding impairment or stoppage of the melting process.

SUMMARY OF THE INVENTION

It is a general object of this invention to provide a melting apparatus that is capable of efficiently handling and melting not only a particulate feedstock mass which is homogeneous and has uniform permeability but also one which is heterogeneous and does not have uniform permeability. It is another object of this invention to provide a melting apparatus that is capable of melting a particulate feedstock mass which contains a wide variety of partical sizes and shapes. For example, in the production of mineral fibers, the feedstock mass may include or be comprised of particles such as large pieces of crushed or uncrushed rock, typically measuring between two and five inches, as well as smaller pieces ranging all the way down to fines or even recycled product in the form of wads of loose or coagulated fibers. It is another object of this invention to provide a geometric relationship between a feedstock pile configuration and the thermal radiating refractory surfaces of the melting chamber that will optimize heat transfer to the surface of the pile, particularly a pile of feedstock material that is opaque to the radiation. It is still another object of this invention to create a toroidal flow of burner gases in a square melting chamber so that a negative pressure vortex region can be induced at a feedstock charge opening located in the center of the chamber roof. It is yet another object of this invention to provide a method of melting particulate feedstock whereby fresh feedstock is fed onto the surface of a freestanding pile of previously charged feedstock, which surface is at or above incipient melting temperature.

The melting apparatus of this invention is for melting a freestanding pile of particulate material in a chamber by means of gas fired burners utilizing waste heat recovered from off-gases by an adjoining recuperator. The chamber is defined by four successively connected planar vertically disposed wall members of substantially equal length, a floor member and a roof member. A preheated air-fuel fired burner is mounted in each wall member adjacent to the corner formed by the tail end of one wall member and the head end of a successive wall member. The axis of each burner is parallel with its successive wall member so the combined effect of the burners is to produce a toroidal flow of combustion products in the melting chamber around its central vertical axis. The melting apparatus includes a forehearth assembly with two or more fuel fired forehearths connected to the downstream end of a distributor. Molten product flows from the melting chamber into the distributor which has a sump where any of the more dense fractions that might be present in the melt may settle to the bottom thereof and be drained off. Then the melt stream divides and flows into the open upstream ends of the respective forehearths where the molten product undergoes further heating and thermal treatment to prepare it for final processing by extraneous equipment, such as mineral fiber spinning machines. The forehearth communicates with the melting chamber through an inlet opening in one wall member of the chamber. A recuperator, for providing preheated air to the melting chamber burners and the forehearth burners, communicates with the melting chamber through an outlet opening in a wall member on the side of the melting chamber opposite from the forehearth inlet wall member. A charge opening is provided in the center of the roof member to admit feedstock to the melting chamber.

The various features, their relationship to one another and their advantages will be understood best if the following description of a preferred embodiment is read in conjunction with the accompanying drawings.

DETAILED DESCRIPTION OF THE INVENTION

Figure 1:
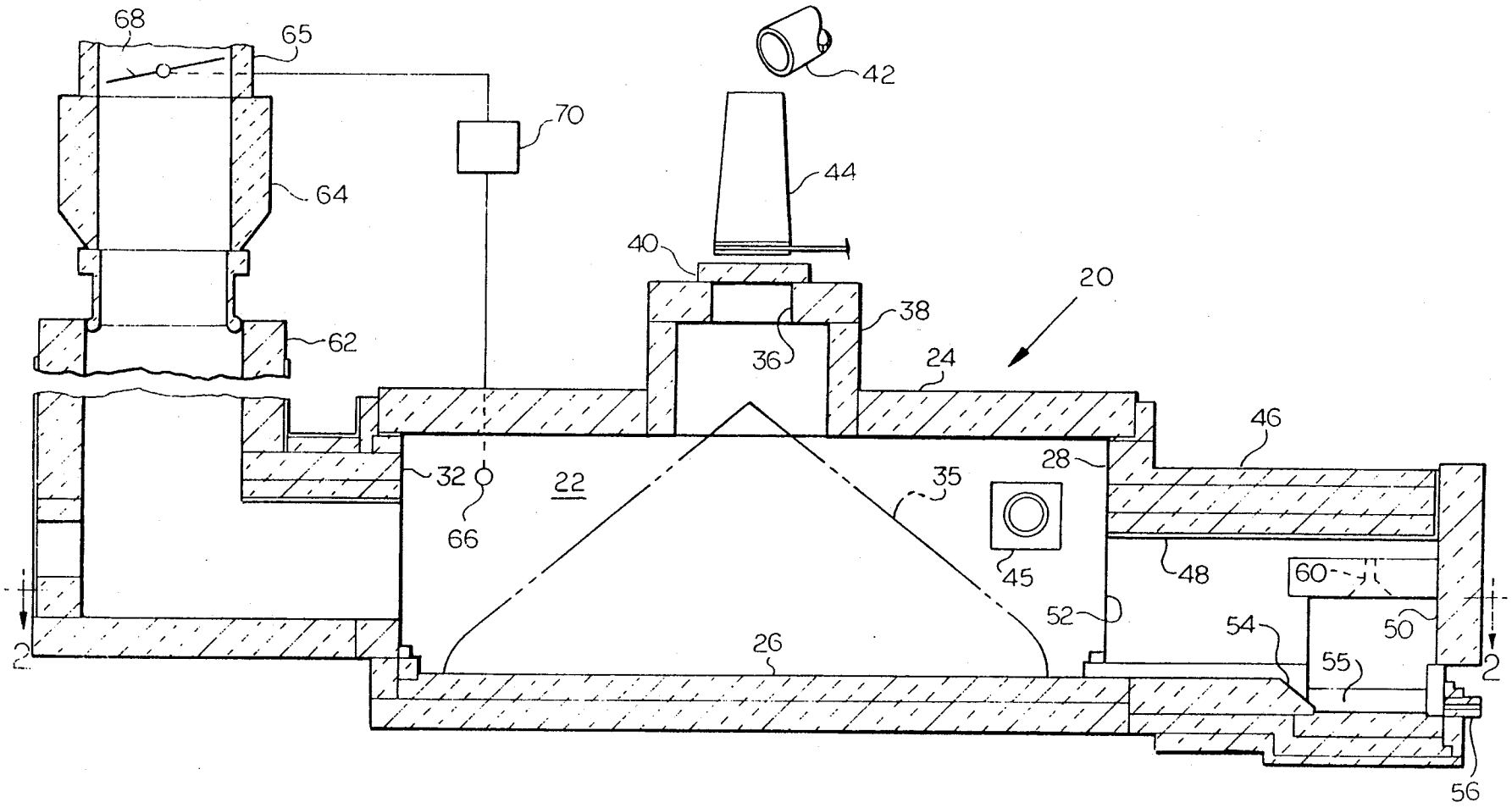
FIG. 1 is a vertical sectional view of the melting apparatus of this invention, with parts broken away, taken along lines 1—1 of FIG. 2.

Generally speaking, the melting apparatus 20 illustrated in the drawings is comprised of a melting chamber 22 having a square horizontal cross section. It is defined by refractory wall members including a horizontal roof member 24, a horizontal floor member 26 and four successively connected vertically disposed sidewall members 28, 30, 32, 34 of equal length forming the periphery of the chamber The cross sectional shape of the melting chamber need not be exactly square but any deviation should be limited to a point such that the chamber remains effectively square for the purposes involved. Preferably, the inside surface of each of these members is substantially planar so as to provide efficient thermal radiation and reradiation between the wall members and the feedstock pile.

An important detail of the invention is the relative size of its members. Ideally, the inside length-to-height ratio of each sidewall member 28, 30, 32, 34 is 3:1. This relationship provides the most effective heat transfer to the surface of a freestanding pile 35 (shown in phantom lines) of feedstock deposited on the floor of the melting chamber. Under extenuating circumstances other ratios between 2.2:1 and 4.4:1 may be used, but in most instances melting efficiency will be reduced.

A charge opening 36 for admitting particulate feedstock to the melting chamber 22 is located in the center of roof member 24. Preferably the charge opening 36 is spaced above the roof of the chamber by means of a short vestibule or shaft section 38 which has a square internal cross section that is symmetrically disposed with respect to the melting chamber. The inside height of the shaft section 38 is less than its width and the ratio of width-to-height is less than the length-to-height ratio of the melting chamber sidewalls. Opening 36 is covered by a removable closure or lid 40. Conveying means 42 is provided for supplying particulate feedstock continuously or intermittently to the melting chamber through the access opening 36. It may include an accumulating hopper assembly 44 in the event charging of the feedstock is to occur intermittently by batches.

Under normal operating conditions, the base of the feedstock pile 35 will extend laterally into proximity with the central bottom portion of each of the four sidewalls and the apex will extend vertically into the bottom o vestibule shaft section 38. Accordingly, the outside surface of the freestanding feedstock pile is slanted inwardly from bottom to top giving it a generally conical configuration. The inclination of the pile surface is fairly constant overall except for a bottom portion of the pile where it drops off precipitously, as shown in FIG. 1. The words "generally conical configuration" are intended to include a conical pile with its bottom edge portion melted away as well as a similar pile in the form of a pyramid with a square cross section. Feedstock piles having pyramidal portions may occur when the apex of the pile is allowed to extend into the shaft 38 and be influenced by contact with the square shape of the exit end of the shaft during the charging process.

The overall geometric relationship between the refractory surface areas of the square melting chamber and the slanting surface areas of the feedstock pile enhances the melting process. It is important to note that in this relationship the horizontal distance between the thermal radiating surface areas of the melting chamber sidewall members and the corresponding feedstock pile surface areas decreases continuously from top to bottom. Similarly, the vertical distance between the thermal radiating surface areas of the melting chamber roof member and the corresponding feedstock pile surface areas decreases continuously from the sides of the chamber to the vestibule in its center. Also, the ratio of the total thermal radiating surface area of the sidewall members to the corresponding feedstock pile surface area at a given level increases continuously from bottom to top.

A high temperature burner 45 designed to operate with a fluid fuel and preheated combustion air is mounted in the tail end of each melting chamber sidewall member adjacent to the junction formed by the tail end of its wall member and the head end of the next succeeding wall member. Natural gas fuel is preferred but other fluid fuels can be used. The axes of the burners are perpendicular to the inside surface of their sidewall members and thus are parallel to the roof member surface as well as the surface of the succeeding sidewall member. Each of the burners 45 is located in the upper half of its sidewall member. Preferably, each of them is located, relative to the surface of the feedstock pile, roof member and succeeding sidewall member, such that its axis is equidistant from the roof member surface, its succeeding sidewall member surface and the surface of the pile at the nearest point, as can be seen in FIG. 1. This arrangement provides the most efficient transfer of heat to the surface of the feedstock pile and produces a toroidal mass flow of combustion products around the vertical centerline of the melting chamber. On the outside of the toroidal flow zone are four relatively quiescent mass flow zones, each involving a volume of space adjacent to one of the corners formed by the sidewall member junctions. Fine particles of matter entrained in the mainstream of toroidally flowing gases tend to drop out of the stream when they reach a quiescent zone. The floor areas beneath these quiescent zones are of substantial size and lie outside of the perimeter of the feedstock pile. Shallow pools of molten product from the feedstock pile collect in these areas while a portion thereof is allowed to flow out of the melting chamber as needed. The surface of the molten material in these areas is exposed to a substantial amount of thermal radiation and thus undergoes some initial refining which may entail oxidation, if desired, and equalization of temperature.

A forehearth assembly 46, which includes a distributor passageway 48 and at least one fuel fired elongated forehearth 50, communicates with the melting chamber via an entrance opening 52 on the upstream end of the distributor. The entrance opening 52 extends through the bottom portion of a melting chamber sidewall member midway between its ends. Although the melting apparatus will operate efficiently with only one fuel fired forehearth, the preferred embodiment has at least two of such forehearths. It has been found that the overall efficiency of the melting apparatus, measured by the total fuel required to produce a unit of molten product at a given temperature, is increased by the use of more than one fuel fired forehearth in combination with one melting chamber rather than pairing a melting chamber one-to-one with a fuel fired forehearth.

Distributor passageway 48 has a rectangular internal cross section and is defined by planar refractory walls. Its bottom wall or floor, at the entrance opening and for a distance downstream therefrom, is level with the melting chamber floor. A downwardly inclined ramp 54 extends from the downstream end of this level section to a collection sump 55. Molten product containing fractions having varing densities flows down the ramp into the sump which has a bottom that is the lowest area in the run. The more dense fractions of molten product settle to the bottom of the sump where they are drawn off through a tap 56. After passing into the sump section, the less dense fractions of the molten product in the upper level of the sump divide and flow towards the distal ends of the elongated forehearths 50.

Figure 2:
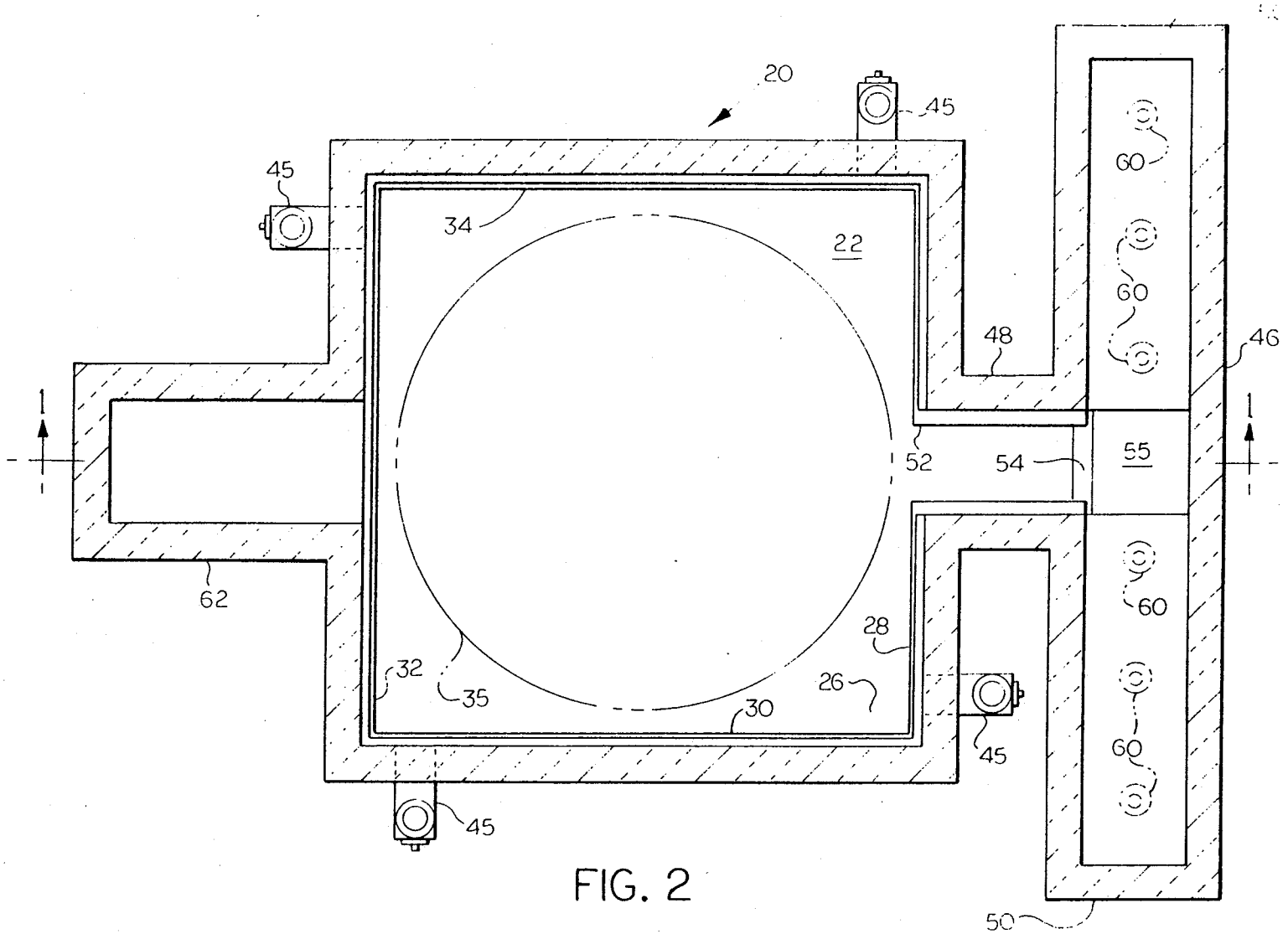
FIG. 2 is a sectional plan view of slightly reduced size taken along lines 2—2 of FIG. 1.

The forehearths are identical in size and have rectangular cross sectional interiors with width, height and length relationships such that their widths equal or exceed their heights and their length-to-width ratios are greater than 3:1. A plurality of downwardly directed flat flame burners 60, shown in phantom lines in FIG. 2, provide high intensity heat transfer to the molten product on the floor of the forehearths. They are located in the roof of each forehearth and arranged singly at equal intervals along its longitudinal centerline. Their purpose is to raise the temperature of the incoming melt to the final temperature required for processing. For example, in the production of mineral fibers the mean temperature of the melt entering the forehearth is nominally 1400 degrees C. and the final temperature is 1500 degrees C. The relatively particle free combustion products from these forehearth burners flow out through the distributor passageway into the melting chamber where they enter the chamber between two quiescent zones. Thereafter they mix with and supplement the toroidally flowing combustion products generated by the melting chamber burners. Partially refined molten product flowing out of the distributor into the respective forehearths is raised in temperature and may be given additional thermal treatment as it travels through them. When the melting apparatus is being used to melt rock material for use in the production of mineral fibers, the refining includes bringing the molten product to a higher uniform working temperature and in the process oxidizing unoxidized portions thereof. Oxidization of the molten product reduces its thermal opacity and thereby improves heat transfer to the molten product. The refined molten product may then be conveyed from the distal ends of the forehearths to their respective mineral wool spinning machines (not shown).

A recuperator assembly 62, attached to the melting chamber sidewall member on the side of the chamber opposite from the forehearth sidewall member, communicates with the interior of the melting chamber through an exit opening in the center thereof, which opening is likewise located between two quiescent zones. The recuperator assembly includes a recuperator section 64 and a stack section 65. Its purpose is to extract heat from the off-gases flowing out of the melting chamber and transfer the recovered heat to the combustion air being supplied to the burners. Additionally, the recuperator assembly provides a means for automatically developing a negative pressure at the feedstock charge or entry opening 36. This is accomplished by means of sufficient stack height, a pressure sensor 66 in the melting chamber, a draft control mechanism including a damper 68 in the stack and a programmed controller 70.

To begin the melting process the particulate material is fed into the cubic melting chamber of the melting apparatus through the feedstock charge opening in the center of the roof of the chamber in an amount sufficient to produce a freestanding generally conically shaped pile which extends from the floor of the melting chamber to its roof. A toroidal flow of hot combustion products is generated around the vertical axis of the pile by means of the preheated air type fluid fuel burners located in the upper half of said chamber adjacent to the corners thereof. The temperature of the combustion products emanating from these burners is sufficient to maintain the refractory surfaces of the chamber walls at a radiant temperature which is above the melting point of the particulate material on the surface of the pile. As the particulate material melts the molten portion flows downward to the floor of the chamber and subsequently from there into a forehearth assembly. In the event the resultant molten product contains an unwanted fraction of higher density material, a sump may be provided at the entrance of the forehearth assembly where this higher density fraction can settle out and be tapped off. Normally, the molten product on the floor of the forehearth will be raised to a higher temperature by means of flat flame burners located in the roof of the forehearth assembly. These latter burners provide a supplemental amount of combustion products which is supplied to the melting chamber from the forehearth assembly through an opening in one side of the chamber. Concurrently, off-gases from the chamber are exhausted to a recuperator through an opening in an opposite side of the chamber. Heat is extracted from these off-gases and transferred to the combustion air which is supplied in turn to the burners.

Although the above description is limited to one illustrated preferred embodiment of the melting apparatus and is directed to the melting of rock for the production of mineral fibers, it is to be understood that the melting apparatus may be used for other purposes. It is also to be understood that in using this apparatus for melting rocks or in adapting it for use in melting other particulate material, minor modifications will become apparent to those skilled in the art and such modifications can be made without departing from the scope of the invention which is defined primarily by the appended claims.

What is claimed is:

1. A melting apparatus for a generally conically shaped freestanding pile of indiscriminate particulate matter contained therein, said apparatus comprising: a melting chamber defined by a roof member, a floor member and four successively connected upright sidewall members all made of refractory material, a burner in each of said sidewall members, said burner being located adjacent to the junction formed by the trailing end of its sidewall member and the leading end of the succeeding sidewall member, a fuel fired forehearth assembly communicating with said melting chamber through an opening in one sidewall member, a recuperator assembly communicating with said melting chamber through an opening in a sidewall member opposite from the sidewall member containing said forehearth opening, and a feedstock charge opening located centrally in said roof member for depositing a freestanding pile of feedstock on said floor member.

2. A melting apparatus according to claim 1 wherein said burners are located in the upper half of said melting chamber and the axis of each burner is parallel to the surface of its succeeding sidewall member so as to produce a region of toroidal flow of combustion products in said chamber centered around a vertical axis of said feedstock pile.

3. A melting apparatus according to claim 2 wherein the axis of each burner is equidistant from the surfaces of its succeeding sidewall member, the roof member and the pile at the nearest point.

4. A melting apparatus according to claim 2 wherein said melting chamber has a plurality of quiescent zones on the outside of said torodial region.

5. A melting apparatus according to claim 4 wherein said forehearth assembly communicates with said melting chamber through an opening disposed between two of said quiescent zones.

6. A melting apparatus according to claim 2 wherein said recuperator has a draft control means which in combination with said toroidal flow is capable of producing a negative pressure at said feedstock charge opening.

7. A melting apparatus according to claim 1 wherein said forehearth assembly includes at least two forehearths branching from a distributor.

8. A melting apparatus according to claim 1 wherein the radiant heat transfer capability from said sidewall members to a unit of surface area of said feedstock pile increases continuously from bottom to top.

9. A melting apparatus according to claim 1 wherein the radiant heat transfer capability from said roof member to a rectilinear unit of surface area of said feedstock pile increases continuously from the center of the chamber to the sidewalls.

10. A melting apparatus according to claim 1 wherein the horizontal distance from the sidewall members to the feedstock pile decreases continuously from top to bottom.

11. A melting apparatus according to claim 1 wherein the vertical distance from the roof member to the feedstock pile decreases continuously from the sides of the chamber to said feedstock charge opening.

12. A melting apparatus according to claim 1 wherein the inside surface of said sidewall members is planar, said sidewall members are of equal length and the ratio of length-to-height of the inside of each sidewall member is between 2.2:1 and 4.4:1.

13. A melting apparatus according to claim 12 wherein said ratio of length-to-height of the inside of each sidewall member is 3:1.

14. A melting apparatus for a generally conically shaped freestanding pile of indiscriminate particulate matter contained therein, said apparatus comprising: a melting chamber defined by a horizontal roof member, a horizontal floor member and four successively connected vertically disposed sidewall members all made of refractory material, a burner in each of said sidewall members, said burner being located in the upper half thereof adjacent to the junction formed by the trailing end of its sidewall member and the leading end of the succeeding sidewall member, a forehearth assembly communicating with said melting chamber through an opening in one sidewall member, a recuperator assembly communicating with said melting chamber through an opening in a sidewall member opposite from the sidewall member containing said forehearth opening, and a feedstock charge opening located centrally in said roof member for depositing a freestanding pile of feedstock on said floor member.

15. A melting apparatus according to claim 14 wherein said forehearth assembly includes at least two forehearths branching from a distributor.

16. A melting apparatus according to claim 14 wherein the inside surface of said sidewall members is planar, said sidewall members are of equal length and the ratio of length-to-height of the inside of each sidewall member is between 2.2:1 and 4.4:1.

17. A melting apparatus according to claim 16 wherein said ratio of length-to-height of the inside of each sidewall member is 3:1.

18. A melting apparatus according to claim 14 wherein the axis of each burner is equidistant from the surfaces of its succeeding sidewall member, the roof member and the pile at the nearest point.

19. A melting apparatus according to claim 14 wherein said burners produce a region of toroidal flow of combustion products around the vertical centerline of said melting chamber and said chamber has a plurality of quiescent zones on the outside of said torodial region.

20. A melting apparatus according to claim 19 wherein said forehearth communicates with said melting chamber through an opening disposed between two of said quiescent zones.

21. A melting apparatus according to claim 14 wherein said recuperator has a draft control means which in combination with said toroidal flow is capable of producing a negative pressure at said feedstock charge opening.

22. A melting apparatus according to claim 14 wherein the horizontal distance from the sidewall members to the feedstock pile decreases continuously from top to bottom.

23. A melting apparatus according to claim 14 wherein the vertical distance from the roof member to the feedstock pile decreases continuously from the sides of the chamber to its center.

* * * * *